US006223857B1

(12) United States Patent
Wyse

(10) Patent No.: US 6,223,857 B1
(45) Date of Patent: May 1, 2001

(54) SCAFFOLDING PLATFORM

(76) Inventor: Steven J. Wyse, 82 Pin Oak, Archbold, OH (US) 42502

( * ) Notice: Subject to any disclaimer, the term of this patent is extended or adjusted under 35 U.S.C. 154(b) by 0 days.

(21) Appl. No.: 09/429,159

(22) Filed: Oct. 28, 1999

(51) Int. Cl.[7] ..... E04G 1/15
(52) U.S. Cl. ..... 182/222; 182/119
(58) Field of Search ..... 182/222, 223, 182/119

(56) References Cited

U.S. PATENT DOCUMENTS

| | | | | |
|---|---|---|---|---|
| 3,093,221 | * | 6/1963 | Purdy . | |
| 5,141,078 | * | 8/1992 | Wood | 182/222 |
| 5,282,519 | * | 2/1994 | Wenturo | 182/151 |
| 5,882,136 | * | 3/1999 | Pyritz | 182/222 |
| 5,915,497 | * | 6/1999 | Krause | 182/119 |
| 5,967,262 | * | 10/1999 | Krause | 182/222 |

FOREIGN PATENT DOCUMENTS

| | | | | |
|---|---|---|---|---|
| 3740910 | * | 7/1988 | (DE) | 182/223 |
| 332061 | * | 9/1989 | (EP) | 182/222 |
| 1112160 | * | 3/1956 | (FR) | 182/222 |
| 7708839 | * | 2/1979 | (SE) | 182/179.1 |

* cited by examiner

*Primary Examiner*—Alvin Chin-Shue
(74) *Attorney, Agent, or Firm*—Hovey, Williams, Timmons & Collins

(57) ABSTRACT

A scaffolding platform (20), having side rails (22,24), one-piece end cross members (26,28), and a panel (30) is utilized to elevate a work surface (32) provided by the panel (30). In an alternate embodiment, the end cross members (26,28) are unitary and hooks (56) are attached to the end cross members (26,28) with hook joints (92). If a hook (56) is damaged, the hook (56) can be removed without separating any of the corner joints (68) which attach the rails (22,24) to the end cross members (26,28). An intermediate cross member (31) is also provided to support the panel (30). The intermediate cross member (31) includes an upper support member (76) which engages the panel (30) and a lower support member (78) which engages the rails (22,24) to maintain spacing.

12 Claims, 2 Drawing Sheets

SCAFFOLDING PLATFORM

FIELD OF THE INVENTION

This invention relates to elevated support surfaces and, more particularly, to portable scaffolding platforms forming an elevated work platform.

BACKGROUND OF THE INVENTION

When workers must be elevated above a floor or ground surface to complete a task, portable scaffolding is frequently assembled to provide an elevated work platform. An exemplary scaffolding platform is illustrated in U.S. Pat. No. 4,825,976 issued to Wyse which is hereby fully incorporated herein by reference. While the scaffolding platform of the '976 patent provides a stable work surface and is generally resistant to damage by virtue of interchangeable hooks. If a hook is damaged, the end section of the platform must be disassembled, so that the damaged hook can be replaced. The end sections of these platforms include over 25 separate pieces, and thus, their complexity makes the end sections undesirably expensive and time consuming to manufacture and assemble.

BRIEF SUMMARY OF THE INVENTION

There is, therefore, provided in the practice of the invention a novel scaffolding platform, which is easily assembled to provide readily portable scaffolding. The scaffolding platform broadly includes substantially parallel front and rear side rails. Opposed, one piece end cross members, with hooks, are attached to opposite ends of the rails, and a panel which provides a work surface, is supported by the side rails.

In a preferred embodiment, the steel end cross members define a pair of hand hold openings in a transverse and substantially vertical end plate. A plurality of weight reducing apertures are defined in substantially horizontal cross plates. The corner joints between the end cross members and the side rails include a generally triangular side plate having a margin integrally joined with the end plate of the end cross member. An intermediate cross member is provided with an upper support member having a generally flat upper surface engaging the panel. The intermediate cross member also includes front and rear legs extending downward from the upper surface with a cylindrical lower support extending between the front and rear legs.

In an alternate embodiment the hooks are joined to the unitary end cross members with fasteners to form hook joints. The hook joints allow the hooks to be removed and replaced without separating the corner joints.

Accordingly, it is an object of the present invention to provide an improved scaffolding platform allowing easy replacement of damaged hooks while minimizing complexity.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figures 1, 2:
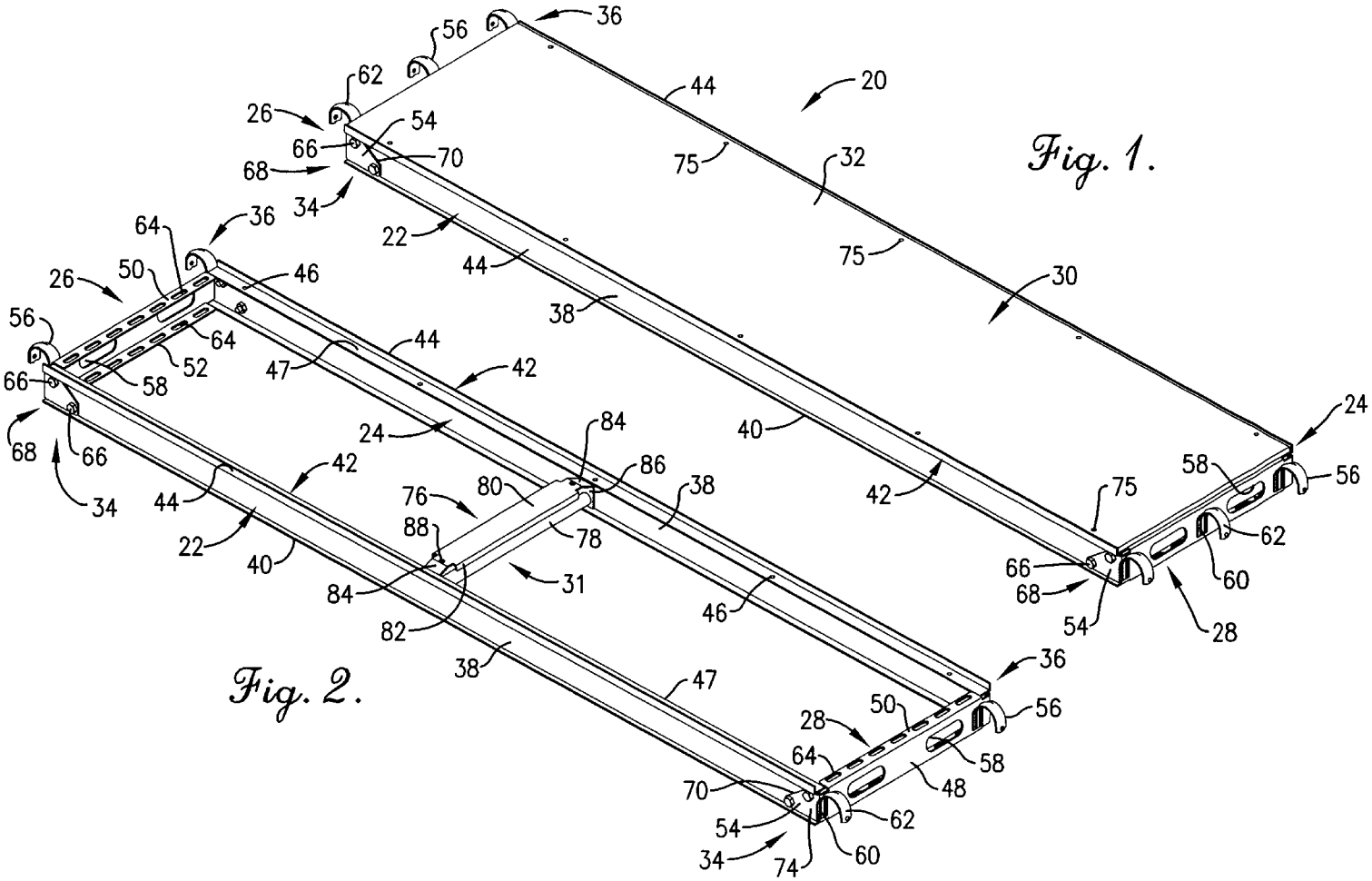
FIG. 1 is a perspective view of a scaffolding platform according to the present invention.
FIG. 2 is a perspective view of the scaffolding platform of FIG. 1 having two hooks on each end and a panel removed for illustrative purposes.

Referring to the drawings in greater detail, FIGS. 1 and 2 show a scaffolding platform 20 constructed in accordance with a preferred embodiment of the present invention. The scaffolding platform 20 broadly includes a pair of opposed side rails 22, 24, opposed end cross members 26, 28, and a panel 30 forming a work surface 32. The rails 22, 24 are attached to the cross members 26, 28, and the panel 30 is supported by the rails 22,24 and cross members 26,28. An intermediate cross member 31 extends between the rails 22, 24 to provide additional support to the panel. The platform 20 is removably attached to a scaffolding frame (not shown) to elevate the work surface 32.

The elongated side rails 22, 24 are preferably made from extruded aluminum and are substantially parallel. The front side rail 22 is elongated between first and second front ends 34, and the rear side rail is elongated between first and second rear ends 36. Each of the rails is substantially identical and will be described further with reference to only one rail with identical reference numerals being applied to both rails.

The rail 22 is generally generally rigid and in the form of an I-beam having a substantially vertical and flat web 38, a substantially horizontal and flat bottom flange 40, and a top flange 42. The top flange 42 includes an upward protruding outer lip 44 which engages the panel to hold it in place. The top flange 42 also defines a plurality of equally spaced panel attachment apertures 46 in the substantially horizontal portion 47 thereof. The outer panel attachment apertures are spaced from the ends 34 of the rail 22, and the panel attachment apertures 46 receive fasteners (not shown) such as rivets, screws, or bolts used to fasten the panel 30 to the side rail.

Figure 4:
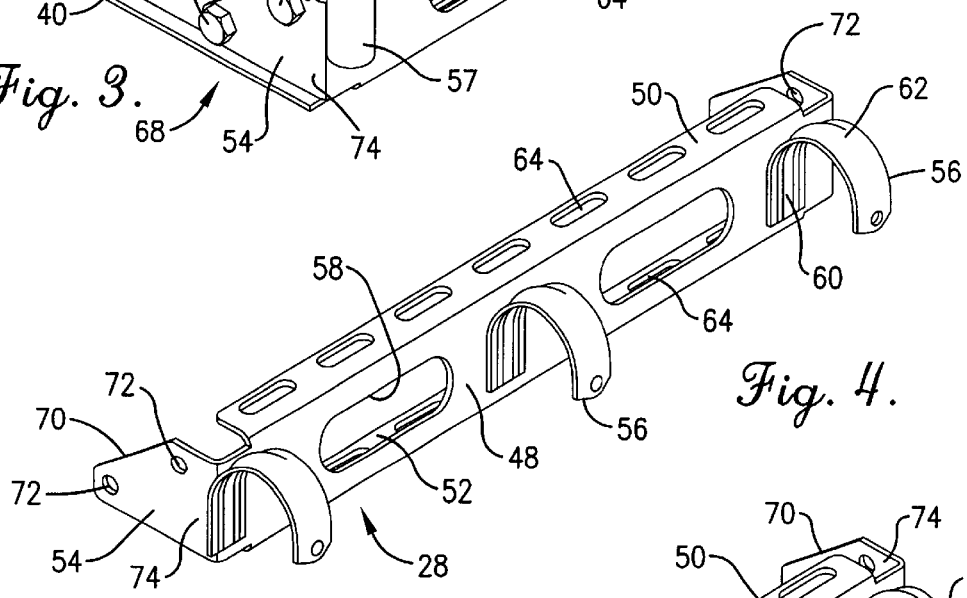
FIG. 4 is a perspective view of an end cross member of the scaffolding platform of FIG. 1.

Referring to FIGS. 2 and 4, the end cross members 26, 28 are preferably formed with steel and are also substantially identical and will be described with reference to only one end cross member with identical reference numerals being applied to both end cross members. The cross member preferably comprises a one piece cross member with an end plate 48, upper and lower cross plates 50, 52, and opposed side plates 54. To form the end cross member as one piece, the end plate 48, cross plates, 50, 52, and side plates 54 are integral to each other, and steel hooks 56 are welded to the outside surface of the end plate 48.

The transversely extending end plate 54 is substantially vertical and defines a pair of hand hold openings 58 symmetrically positioned relative to the center of the cross member. The hand hold openings 58 are slot-shaped with rounded ends. In the embodiment shown in FIG. 4, three equally spaced hooks are welded to the end plate 48. The middle hook is positioned between the hand hold openings 58, and the outer hooks are positioned outside of the hand hold openings 58. The hooks are offset from center, allowing two platforms to hook over a common scaffolding frame member (not shown). In the embodiment of FIG. 2, only two hooks 56 are utilized. The number of hooks is determined by the width of the panel 30 and the structural requirements of the platform. Each hook includes a leg 60 welded to the end plate 48 and a loop portion 62, preferably one half of the circle, which extends outwardly from the hook leg 60.

Figure 3:
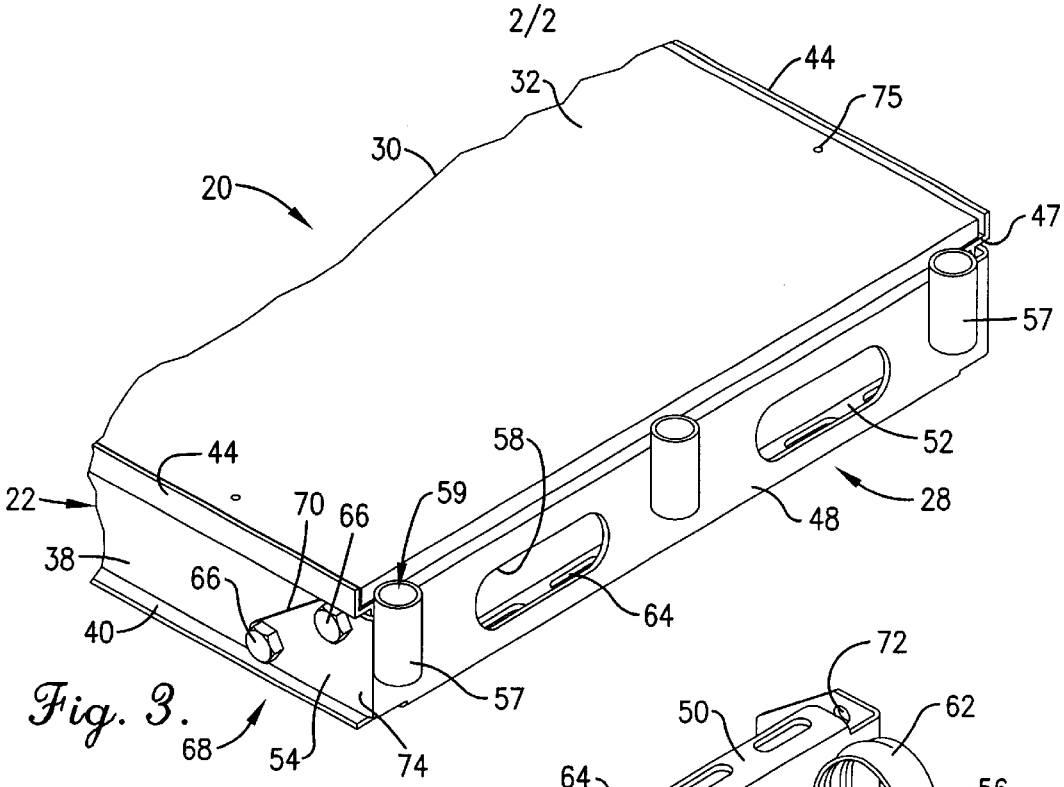
FIG. 3 is fragmentary perspective view of the scaffolding platform of FIG. 1 illustrating alternate hooks.

Referring briefly to FIG. 3, an alternate hook 57 comprises a cylindrical tube defining a central opening 59 for receiving a scaffolding frame member therethrough. In this embodiment, the bottom of the hooks 57 would rest against a stop provided by the scaffolding frame.

Referring again to FIGS. 2 and 4, the transversely extending upper and lower cross plates 50, 52 are integrally joined with the end plate 48 and are substantially horizontal. The cross plates 50, 52 define weight reducing upper and lower apertures 64. The weight reducing apertures 64 are preferably slot-shaped with rounded ends and can also be used to fasten the panel 30 to the end cross member 26. Preferably, the weight reducing slots 64 are formed throughout the length of the cross plates 50, 52. The upper and lower cross plates 50, 52 are formed by bending, so that they are approximately coplanar with the horizontal portion 47 of the top flange 42 and the bottom flange 40, respectively.

The longitudinal extending side plates 54 are generally triangular and are attached to the web 38 of the rail 22 with two corner fasteners 66 to form a corner joint 68. There are four corner joints 68 in each platform 20. The triangular side plates 54 include a beveled upper corner 70 with two corner fastener holes 72 angled along the beveled upper corner 70. An end margin 74 of the triangle is integrally joined with the end plate 48 of the end cross member 26.

Referring to FIG. 1, the substantially rigid and flat panel 30 is preferably made of wood and is supported along its length by the side rails 22, 24 and at its ends by the end cross members 26,28. The panel defines openings 75 along its edges which are aligned with the panel attachment apertures 46 of the side rails to receive fasteners.

Referring to FIG. 2, the intermediate cross member 31 is positioned centrally between the end cross members 26, 28 and extends transversely between the substantially parallel side rails 22, 24. The intermediate cross member 31 includes an upper support member 76 and a lower support member 78.

The upper support member 76 includes a flat upper surface 80 which is substantially coplanar with the horizontal portions 47 of the top flanges 42 of the side rails 22, 24. Thus, the upper surface 80 engages and supports the panel 30. Side flanges 82 extend from the upper support member 76 to rigify the upper surface 80. Downwardly angling panels 84 extend from the upper surface 80 and reach below the horizontal portions 47 of the top flange 42 of the side rails 22, 24. Opposed front and rear legs 86 extend downwardly from the panels and engage the webs 38 of the side rails 22, 24. The upper support member 76 is provided with attachment holes 88, which receive fasteners to attach the upper support member 76 to the panel 30. Alternatively, the opposed legs 86 are attached to the webs 38 of the rails. The upper support member 76 is preferably integrally formed with the panels 84 and legs 86 being formed by bends.

The lower support member 78 extends transversely between the opposed legs 86 of the upper support member 76. Preferably, the lower support member is cylindrical and is welded to the opposed legs 86 at its opposite ends. The lower support member 78 is preferably positioned directly below and spaced apart from the upper support surface 80. Thus, the lower support member is positioned between the side flanges 82 of the upper support member 76 and maintains the desired spacing between the rails.

Figure 5:
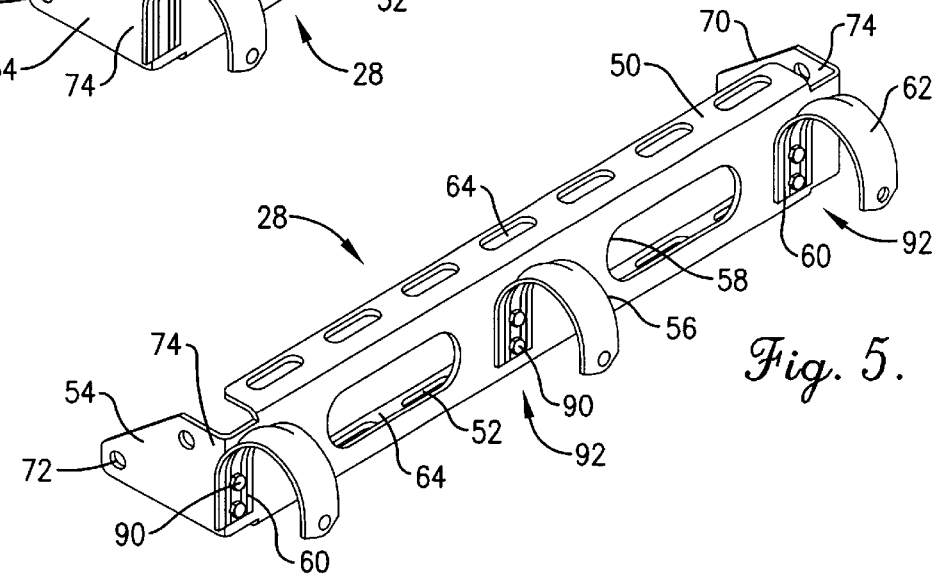
FIG. 5 is a perspective view of an alternate end cross member illustrating removable hooks.

Referring to FIG. 5, in an alternate embodiment, the hooks 56 are attached to the end plate 48 with fasteners 90 which extend through the hook legs 60 to form a plurality of hook joints 92 between the hooks and the end plates 48 of the end cross members 26, 28. Thus, the end cross members are unitary with separate hooks attached thereto. The hook joints 92, which preferably use two fasteners each, allow the hooks to be removed and replaced without separating any of the plurality of corner joints 68.

Referring again to FIG. 1, with the first end cross member 26 attached to the first front and rear ends of the rails 22, 24 and the second end cross member 28 attached to the second front and rear ends of the rails, the panel 30 is held between the outer lips 44 of the rails. The scaffolding platform 20 according to the present invention provides a structurally sound scaffolding allowing easy replacement of damaged hooks while minimizing complexity.

Thus, a scaffolding platform is disclosed which utilizes one piece end cross members to minimize complexity while maintaining repairability and stability. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A scaffolding platform for providing an elevated work surface, the platform comprising:

a front side rail elongated between a first front end and a second front end;

a rear side rail elongated between a first rear end and a second rear end, and the rear side rail extending substantially parallel to the front side rail;

a first, one piece end cross member including a plurality of first hooks, and the first end cross member being detachably secured by respective corner joints to the first front end and the first rear end;

a second, one piece end cross member including a plurality of second hooks, and the second end cross member being detachably secured by respective corner joints to the second front end and the second rear end;

an elongated panel extending between the end cross members and supported along its length by the side rails, and the panel providing the work surface, at least one of said corner joints includes a cross member side plate and at least one corner fastener attaching the side plate to a web of the side rail.

2. The scaffolding platform according to claim 1 wherein the first and second end cross members comprise steel end cross members.

3. The scaffolding platform according to claim 1 wherein each of the first and second end cross members includes an end plate defining a pair of hand hold openings.

4. The scaffolding platform according to claim 1 wherein each of the first and second end cross members each includes an upper cross plate defining weight reducing, upper apertures and a lower cross plate defining weight reducing, lower apertures.

5. The scaffolding platform according to claim 1 further comprising an intermediate cross member including an upper support member having a generally flat upper surface engaging and supporting the panel, front and rear opposed legs extending downwardly from the intermediate cross member and being attached to the front and rear side rails respectively, and a lower support member extending between the front and rear legs and below the upper support member.

6. The scaffolding platform according to claim 1, wherein the cross member side plate is generally triangular in shape.

7. A scaffolding platform for providing an elevated work surface, the platform comprising:

a front side rail elongated between a first front end and a second front end;

a rear side rail elongated between a first rear end and a second rear end, and the rear side rail extending substantially parallel to the front side rail;

a first, end cross member;

a second, end cross member;

a plurality of corner joints attaching the first end cross member to the first front end and the first rear end, and attaching the second end cross member to the second front end and the second rear end;

an elongated panel supported along its length by the side rails, and the panel providing the work surface; and a plurality of hooks, with each hook being detachably secured to a respective one of the end cross members by at least one threaded fastener, and the hook being detachable without separating the respective end cross member from either one of the side rails, wherein at least one of said corner joints includes a cross member side plate, with an end margin of the cross member side plate being integrally joined with an end plate of a respective one of the end cross members, and at least one corner fastener attaching the side plate to the web of the side rail.

8. The scaffolding platform according to claim 7 wherein the first and second end cross members are unitary.

9. The scaffolding platform according to claim 7 wherein each of the end cross members includes an end plate defining at least one hand hold opening.

10. The scaffolding platform according to claim 7, wherein the cross member side plate is generally triangular in shape.

11. A scaffolding platform for providing an elevated work surface, the platform comprising:

a front side rail elongated between a first front end and a second front end;

a rear side rail elongated between a first rear end and a second rear end, and the rear side rail extending substantially parallel to the front side rail;

a first, one piece end cross member including a plurality of first hooks, and the first end cross member being attached to the first front end and the first rear end;

a second, one piece end cross member including a plurality of second hooks, and the second end cross member being attached to the second front end and the second rear end;

an elongated panel extending between the end cross members and supported along its length by the side rails, and the panel providing the work surface; and an intermediate cross member including an upper support member having a generally flat upper surface engaging and supporting the panel, front and rear opposed legs extending downwardly from the upper support member and being attached to the front and rear side rails respectively, and a lower support member extending between the front and rear legs and below the upper support member, said lower support member comprises a cylinder.

12. A scaffolding platform for providing an elevated work surface, the platform comprising:

a front side rail elongated between a first front end and a second front end;

a rear side rail elongated between a first rear end and a second rear end, and the rear side rail extending substantially parallel to the front side rail;

a first, one piece end cross member including a plurality of first substantially vertical cylinders defining central openings for receiving scaffolding frame members therein, and the first end cross member being detachably secured by respective corner joints to the first front end and the first rear end;

a second, one piece end cross member including a plurality of second substantially vertical cylinders defining central openings for receiving scaffolding frame members therein, and the second end cross member being detachably secured by respective corner joints to the second front end and the second rear end; and an elongated panel extending between the end cross members and supported along its length by the side rails, and the panel providing the work surface, wherein at least one of the corner joints includes a cross member side plate and at least one corner fastener attaching the side plate to a web of the side rail.

* * * * *